United States Patent [19]

Liotta

[11] 4,299,684

[45] Nov. 10, 1981

[54] DEMINERALIZATION OF COAL

[75] Inventor: Ronald Liotta, Clark, N.J.

[73] Assignee: Exxon Research & Engineering Co., Florham Park, N.J.

[21] Appl. No.: 164,240

[22] Filed: Jun. 30, 1980

[51] Int. Cl.[3] ..... C10G 1/00; C10B 57/04

[52] U.S. Cl. ..... 208/8 LE; 208/46; 201/20

[58] Field of Search ..... 208/8 LE, 46; 201/20

[56] References Cited

U.S. PATENT DOCUMENTS

| | | | |
|---|---|---|---|
| 2,378,762 | 6/1945 | Frey | 208/46 |
| 3,330,757 | 7/1967 | Bichard | 208/11 LE |
| 3,359,197 | 12/1967 | Mosciantonio et al. | 208/14 |
| 3,376,212 | 4/1968 | Mosciantonio et al. | 208/2 |
| 3,992,432 | 11/1976 | Nopier et al. | 200/465.1 |
| 3,998,604 | 12/1979 | Hinkley | 44/1 R |
| 4,059,410 | 11/1977 | Schlosberg et al. | 44/1 R |
| 4,072,475 | 2/1978 | Schlosberg et al. | 44/1 R |
| 4,089,772 | 5/1978 | Gorboty et al. | 208/8 LE |
| 4,092,235 | 5/1978 | Schlosberg et al. | 208/8 LE |
| 4,121,910 | 10/1978 | Stambaugh | 44/1 B |

FOREIGN PATENT DOCUMENTS 851191 5/1977 Belgium .

OTHER PUBLICATIONS

"Bradstrom" et al., vol. 23, Acta. Chem. Scand., p. 2202, (1969).

Wagenknecht et al., vol. 2, Synthetic Communications, pp. 215–219, 1972.

McKillop et al., vol. 30, Tetrahedron, pp. 1379–1382, (1974).

"Bashall" et al., Tetrahedron Letters, pp. 3489–3490, (1975).

"Eckhard" et al., Tetrahedron Letters, pp. 95–96, (1976).

German "Off." DT-2634419.

"Blom" et al., vol. 36, Fuel, pp. 135–153, (1957).

"Yohe" et al., vol. 69, Journal of Amer. Chem. Soc., pp. 2644–2648, 1947.

"Sternberg et al.," vol. 53, Fuel, pp. 172–175, (1974).

"Heathcoat" et al., J. of the Chem. Society, p. 2839FF, (1932).

"Kroger" et al., vol. 18, Erdol und Kohle Erdgas Petrochemie, pp. 368–372, 1965.

Sokolova et al., vol. 1, Trudy Inst. Nefti, Akad. Nauk SSSR, pp. 277–284, 1950.

"Fugassi" et al., Am. Chem. Soc. Div. of Gas Fuel Chem. Preprints, pp. 125–131, 1958.

"Hodek" et al., vol. 52, Fuel, pp. 220–225, (1973).

"Olleman" vol. 24, Anyl, Chem., pp. 1425–1439, (1952).

"Lahiri" et al., vol. 36, Fuel, pp. 254–256, (1957).

vol. 20 J. of Indian Chem. Soc., Ind. and News Ed., pp. 91–94, 1957.

"Zabavin", Bulletin of Academy of Science, Tech. No. 8, pp. 35–49, 1943.

"Danetskaya" Gigiena i Sanit, pp. 26–31, (1952).

*Primary Examiner*—Delbert E. Gantz

*Assistant Examiner*—William G. Wright

*Attorney, Agent, or Firm*—Henry E. Naylor

[57] ABSTRACT

Disclosed is a method for comminuting and simultaneously removing mineral matter from coal by first treating the coal with a quaternary base solution, such as tetrabutylammonium hydroxide, then physically separating the mineral matter by any conventional separation technique based on the density differences of two materials.

20 Claims, No Drawings

DEMINERALIZATION OF COAL

FIELD OF THE INVENTION

This invention relates to a method for comminuting and removing mineral matter from coal by treating the coal with a quaternary base solution.

BACKGROUND OF THE INVENTION

Because of rapidly dwindling petroleum reserves, coal has evidenced increasing importance as a source of fuel. Many processes have been developed to utilize coal directly in solid form by combustion, or by first converting it to useful liquids and gases. However, many of these processes suffer because of problems associated with the mineral matter contained in coal. For example, mineral matter in coal can cause recycle problems in liquefaction processes by causing the loss of hydrogen to form the undesirable side product $H_2S$. Mineral matter can also be a problem if the coal is burned directly because mineral matter contributes to slagging problems. Mineral matter in coal will also contribute to the release of sulfur dioxide as a pollutant. Therefore, it is highly desirable to remove as much of the mineral matter as possible before coal utilization.

Although various methods have been proposed for the removal of mineral matter from coal, there is still a need in the art for the development of more efficient and effective demineralization methods, especially if chemical comminution of the coal can be simultaneously achieved.

SUMMARY OF THE INVENTION

In accordance with the present invention, there is provided a method for demineralizing and comminuting coal which method comprises: (a) treating the coal with a quarternary base solution, and (b) separating the mineral matter from the treated coal. The quaternary base solution contains one or more quaternary bases represented by the formula:

$$R_4MOR'$$

where each R is the same or different group selected from the $C_1$ to $C_{20}$ alkyl, aryl, acyl, arylalkyl, alkylaryl, ether, ester, as well as, sulfide and amine, or an atom of silicon, selenium or a metal selected from Groups IA and IIA of the Periodic Table of the Elements; M is selected from Group VA of the Periodic Table of the Elements; and R′ is hydrogen, a $C_1$ to about $C_{20}$ preferably a $C_1$ to $C_{10}$ alkyl, aryl, arylalkyl or alkylaryl; more preferably R′ is hydrogen or a methyl group; and most preferably R′ is hydrogen.

In a preferred embodiment of the present invention, the quaternary base is regenerated and recycled.

DETAILED DESCRIPTION OF THE INVENTION

Any type of coal can be treated according to the present invention, provided acidic protons are present thereon. Non-limiting examples of coals suitable for use herein include anthracite, bituminous, subbituminous, and lignite. It will be noted that peat may also be demineralized according to the present invention. Typically, the aforementioned coals have the following character; carbon content ranging from about 55 to 93 wt. %; hydrogen content ranging from about 2.2 to 6.2 wt. %; and an oxygen content ranging from about 3 to 23 wt. % (DMMF—dry mineral matter free basis); and, an H/C ratio ranging from about 0.3 to 1.1.

Although not wishing to be limited by theory, it is believed that the quaternary base reacts with the organic acidic sites of the coal by forming a salt therewith, thereby rendering the organic portion of the coal lower in density after treatment. Examples of such acidic sites include the more acidic organic functionalities such as phenolic, carboxylic, and mercaptan, as well as the weaker acidic organic functionalities such as amines. The most abundant acidic functionality in coal is the phenolic functionality, especially when higher ranked coals are employed. Furthermore, by the practice of this invention, the coal undergoes chemical comminution, leaving the treated coal with a reduced particle size when compared to untreated coal. Because the density of the organic portion of the coal has been substantially reduced relative to the inorganic, or mineral matter portion, it can be separated from the inorganic portion by any conventional method used for physically separating materials of different densities. Non-limiting examples of such methods include froth floatation, sink floatation, and centrifugation.

Quaternary bases suitable for use herein are those represented by the formula:

$$R_4MOR'$$

where each R is the same or different group selected from the $C_1$ to about $C_{20}$ alkyl, aryl, acyl, arylalkyl, alkylaryl, ether, ester, as well as sulfide, amine, and an atom of silicon, selenium, or a metal selected from Groups IA and IIA of the Periodic Table of the Elements. Preferably R is a $C_1$ to $C_{20}$ alkyl, aryl, acyl, arylalkyl or alkylaryl; more preferably R is a $C_1$ to $C_6$ alkyl or aryl group and most preferably R is a $C_1$ to $C_4$ alkyl group. M is selected from Group VA of the Periodic Table of the Elements, preferably nitrogen or phosphorus, more preferably nitrogen. R′ is hydrogen, a $C_1$ to about $C_{20}$; preferably a $C_1$ to $C_{10}$ alkyl, aryl, arylalkyl or alkylaryl; more preferably R′ is hydrogen or a $C_1$ to $C_4$ alkyl group; most preferably R′ is hydrogen. By Periodic Table of the Elements we mean that table of the chemical elements which is represented on the inside covers of the Handbook of Chemistry and Physics, 55th Edition, by CRC Press. Non-limiting examples of such quaternary bases suitable for use herein include tetramethylammonium hydroxide and alkoxide, tetraethylammonium hydroxide and alkoxide, tetrapropylammonium hydroxide and alkoxide, tetrabutylammonium hydroxide and alkoxide, tetrapentylammonium hydroxide and alkoxide, tetrahexylammonium hydroxide and alkoxide, benzylhexadecyldimethyl ammonium hydroxide and alkoxide, tetramethylphosphonium hydroxide and alkoxide, tetraethylphosphonium hydroxide and alkoxide, tetrapropylphosphonium hydroxide and alkoxide, tetrabutylphosphonium hydroxide and alkoxide, tetrapentylphosphonium hydroxide and alkoxide, tetrahexylphosphonium hydroxide and alkoxide, and benzylhexadecyldimethylphosphonium hydroxide and alkoxide. Preferred are the ammonium hydroxides and $C_1$ to $C_4$ alkoxides, more preferred are the ammonium hydroxides and most preferred is tetramethylammonium hydroxide.

The quaternary base as used herein is in solution form and can be prepared by dissolving the corresponding quaternary salt is in a solvent selected to give the desired base. Non-limiting examples of such solvents suitable for use herein include water, $C_1$ to $C_{20}$ aliphatic alcohols, phenol, etc. For example, if the desired base of a particular quaternary salt is the corresponding hydroxide, then the quaternary salt is dissolved in water. Furthermore, if the desired base is a methoxide, then methanol is used as the solvent. In other words, the complementary alcohol to the alkoxide etc. is used to dissolve the quaternary salt. It will be noted that only a stoichiometric amount of solvent is needed to convert the quaternary salt to the corresponding base; preferably an excess amount of such solvent is employed so that in actuality it functions as a solvent.

It is also within the scope of this invention to use a co-solvent, which may act to increase the reaction rate. Non-limiting examples of co-solvents suitable for use herein include tetrahydrofuran, benzene, toluene, etc. When a co-solvent is employed, the amount of solvent which is required is just enough to dissolve the reagents, although greater amounts may also be employed.

It is preferred that a stoichiometric amount of quaternary base be employed relative to the number of available acidic protons of the coal or peat. Of course, the actual amount of quarternary base employed will be dependent on the degree to which one wishes to remove mineral matter. For example, it may be desirable from an economic point of view to remove only a small fraction of the mineral matter in order to up-grade the coal or peat to meet certain specifications. Therefore, less than a stoichiometric amount of base would be required.

Preferably, the coal is contacted with the quaternary base at a temperature from about 0° C. to about 100° C. If temperatures greater than about 125° C. are employed, the coal may undergo an alkylation reaction, which may or may not be desirable. Therefore, when only demineralization and comminution are the desired result, the temperature is kept below about 100° C.

The coal is contacted with the quaternary base for an effective amount of time, that is, for a time long enough to effect the reaction of base with the acidic functionalities of the coal. Generally this time is about 5 to 100 minutes at room temperature, 25° C. Increased temperature will, of course, increase the rate of reaction. Furthermore, the demineralization and comminution of the present invention is conveniently and preferably carried out at atmospheric pressure, although other pressures can be employed.

When the coal or peat is brought into contact with the quaternary base solution for an effective amount of time, comminution of the coal results. This breaking-up, or comminution of the coal or peat facilitates the separation of the inorganic fraction and the organic fraction of the coal or peat. The organic fraction evidences a reduction in density owing to its reaction with the quaternary base. Therefore, the relative differences of density between the organic fraction and the inorganic fraction enables a majority of both fractions to be separated from each other by conventional physical separation techniques.

Conventional physical separation techniques suitable for use herein include any of those techniques based on the density differences of the materials to be separated. One preferred separation method is the sink float method wherein the solvent employed has a density less than the inorganic component but greater than the organic component. By selecting such a solvent, the inorganic component will sink and the organic component will float, thereby effecting the separation of the two. If such a solvent is not chosen, that is, if both the inorganics and organics sink or float in the solvent, then separation may be accomplished by centrifugation.

It is generally believed that major inorganic constituents in coal include those of silicon, aluminum, iron, calcium, magnesium, sodium, potassium, manganese, sulfur and phosphorus. For example, silicon is usually found in the form of silicates of such elements as calcium, magnesium, etc. Iron is usually found, to a major extent, as pyrite ($FeS_2$), which is generally considered the most undesirable impurity because of its abundance, as well as its high sulfur content. By the practice of this invention a relatively high percentage (about 75 wt. %) of pyrite was removed by using a stoichiometric amount of quaternary base, such as tetrabutylammonium hydroxide, to acidic protons on No. 6 bituminous coal.

After the inorganic portion is separated out, the remaining organic portion, which has reacted with the quaternary base, is dispersed in the quaternary base solution. This solution can be further treated, with a regenerating material, to regenerate the quaternary base for recycling purposes. Non-limiting examples of materials suitable for regenerating the quaternary base include those materials selected from the group consisting of water, strong aqueous alkali and alkaline-earth metal bases, mineral acids and water soluble low molecular weight organic acids such as acetic acid. To effect regeneration of the quaternary base, the organic portion-containing solution is generally brought into contact with the regenerating material solution, preferably at atmospheric temperature and pressure, for a time sufficient to effect regeneration of the quaternary base. The entire resulting solution, which now contains the regenerated quaternary base, can be recycled to the coal or peat feed. It will be noted that lime, calcium oxide, can be used as the regenerating material and is added directly to the organic portion-containing solution in solid form.

If water is used alone as the regenerating material, large quantities must be employed; therefore, from an economical point of view, water would generally not be the preferred regenerating material. The concentration of the other regenerating materials is not particularly important except for the fact that higher concentrations are preferred because less water is required. Of course, the economics of the particular apparatus and process will dictate the optimum concentration of regenerating material which can be easily determined by those possessing ordinary skill in art.

The coal, after treatment herein, is substantially freer in mineral matter and the subject method can be repeated to remove additional amounts of mineral matter.

The present invention is particularly useful for treating coal mine tailings. These tailings are generally finely ground coal which usually have a substantially higher mineral matter content than the basic coal itself. These tailings are produced as a by-product of mining and heretofore there was little use for them. Now, by use of the present invention, a substantial amount of the mineral matter can be removed from coal tailings, thereby rendering the tailings more commercially valuable, i.e., as an onsite fuel or a material for further processing, such as liquefaction and gasification.

The following examples serve to more fully describe the manner of practicing the above-described invention, as well as to set forth the best modes contemplated for carrying out various aspects of the invention. It is understood that these examples in no way serve to limit the true scope of this invention, but rather, are presented for illustrative purposes.

EXAMPLE 1

Ten grams of Illinois No. 6 bituminous coal was mixed with about 46 ml 1 molar solution of tetrabutylammonium hydroxide in water, at 25° C. and one atmosphere pressure. This amount of tetrabutylammonium hydroxide represented about a stoichiometric amount of hydroxide based on the available acidic proton content of the coal. The mixture was centrifuged for four hours at about 2,400 rpm. The sample was examined after centriguation and the bottom layer of solids was found to be (by X-ray analysis) substantially all pyrite. The organic layer located above the more dense inorganic layers was removed and neutralized with dilute HCl to restore the original covalent structure of the coal. By control experiments it was found that the HCl treatment had little effect on the mineral matter content of the sample.

The overall inorganic content of the coal was found to be reduced by about 50 wt. %, based on the total inorganics originally present. Table I below shows the removal of the major inorganic components in the coal; pyrite, silicon silicate, silica, and sodium compositions.

TABLE I

Elemental Composition of Illinois No. 6 Coal Before and After Treatment

| Inorganic Component | wt. % Before | Wt. % After | % Removal |
|---|---|---|---|
| Pyrite | 3.4 | 0.84 | 75.3 |
| Silicon | 3.0 | 1.8 | 40 |
| Aluminum | 1.0 | 0.75 | 25 |
| Sodium | 0.55 | 0.0 | 100 |

EXAMPLE 2

The procedure of the above Example 1 was followed except tetrabutylammonium methoxide in methanol was employed. It was found that 28 wt. % of the coal dissolved in the basic methanol solution. That is 28 wt. % of the coal was completely demineralized when dissolved because none of the mineral matter was found to be dissolved in the methanol solution. Centrifugation of the remaining 72 wt. % of the sample produced results similar to those reported in Example 1 above. That is, about a 50 wt. % in mineral matter content of the remaining 72 wt. % of the sample (adjusted for the removal of the 28 wt. % based on the total weight of the sample) organic component.

EXAMPLE 3

The procedure of Example 1 above was followed except tetraethylammonium hydroxide was used as the quaternary base. It was found that about 40 wt. % of the mineral matter (based on the total amount of mineral matter present in the sample) was separated.

COMPARATIVE EXAMPLE

The procedure of Example 1 above was employed except ammonium hydroxide was used in place of a quaternary base as defined herein. It was found that only 21 wt. % of the mineral matter of the sample was removed. This example evidences that the quaternary bases of the present invention lead to an unexpectedly high level of mineral matter removal when compared to conventional bases of equivalent strength.

EXAMPLES 4 to 12

The following is a table illustrating additional quaternary bases which can be employed on various coal and peat samples. It is preferred that each of these bases be used in a stoichiometric amount relative to the number of acidic protons on the coal or peat.

TABLE II

| Ex. | Base | Material to be Treated |
|---|---|---|
| 4 | tetramethylammonium methoxide | bituminous coal |
| 5 | tetramethylphosphonium hydroxide | subbituminous coal |
| 6 | tetramethylammonium ethoxide | peat |
| 7 | tetramethylarsenous hydroxide | bituminous coal |
| 8 | tetramethylammonium butoxide | anthracite |
| 9 | tetraethylammonium methoxide | lignite |
| 10 | tetraethylammonium ethoxide | subbituminous coal |
| 11 | dimethyldiethylammonium hydroxide | peat |
| 12 | trimethylethylammonium hydroxide | bituminous coal |

After treatment of the materials with the respective quaternary bases, it will be expected that the wt. % of mineral matter removal will be comparable to that obtained in Examples 1 to 3 above.

What is claimed is:

1. A method for comminuting and simultaneously removing mineral matter from coal or peat which method comprises:

(a) treating the coal with a guaternary base solution, thereby producing a solution containing the organic fraction of the coal and mineral matter, (b) separating mineral matter from the organic portion of the coal by a physical separation technique based on the density differences of materials, wherein the quaternary base solution contains at least one quaternary base represented by the formula:

$R_4MOR'$ where each R is the same or different group selected from the $C_1$ to $C_{20}$ alkyl, aryl, acyl, arylalkyl, alkylaryl, ether, ester, as well as, sulfide, amine, heteroatoms of silicon, selenium or a metal selected from Groups IA and IIA of the Periodic Table of the Elements, M is selected from Group VA of the Periodic Table of the Elements, and R' is hydrogen or a C'to $C_{20}$ alkyl, aryl, arylakyl or alkylaryl group.

2. The method of claim 1 wherein each R is the same or different $C_1$ to $C_6$ alkyl or aryl group.

3. The method of claim 2 wherein each R is the same or different $C_1$ to $C_4$ alkyl group.

4. The method of claim 1 wherein M is selected from the groups consisting of nitrogen and phosphorus.

5. The method of claim 3 wherein M is selected from the group consisting of nitrogen and phosphorus.

6. The method of claim 1 wherein R' is hydrogen or a $C_1$ to $C_4$ alkyl group.

7. The method of claim 6 wherein R' is hydrogen.

8. The method of claim 5 wherein R' is hydrogen.

9. The method of claim 1 wherein the mineral matter is separated from the organic portion of the coal or peat by the technique of sink-floatation, froath-floatation or centrifugation.

10. The method of claim 8 wherein the mineral matter is separated from the organic portion of the coal or peat by sink-floatation.

11. The method of claim 1 wherein the temperature is about 0° to about 100° C.

12. The method of claim 10 wherein the coal or peat is contacted with the quaternary base at a temperature from about 0° to 100° C.

13. The method of claim 1 wherein the quaternary base is regenerated by contacting the solution containing the organic portion of the treated coal or peat with a regenerating material selected from the group consisting of water, alkali bases, alkaline earth metal bases, mineral acids, and water soluble organic acids.

14. The method of claim 12 wherein the quaternary base is regenerated by contacting the solution containing the organic portion of the coal or peat with a regenerating material selected from the group consisting of water, alkali bases, alkaline earth metal bases, mineral acids, and water soluble organic acids.

15. The method of claim 1 which is repeated at least one more time on the coal or peat to effect the separation of additional amounts of remaining mineral matter.

16. The method of claim 1 wherein the coal consists of coal mine tailings.

17. The method of claim 1 wherein a stoichiometric amount of quaternary base is employed based on the amount of available acidic proton content of the coal or peat.

18. The method of claim 14 wherein a stoichiometric amount of quaternary base is employed based on the amount of available acidic proton content of the coal or peat.

19. The method of claim 4 wherein the quaternary base is selected from the group consisting of tetramethylammonium hydroxide and methoxide, tetraethylammonium hydroxide and methoxide, tetrapropylammonium hydroxide and methoxide, tetrabutylammonium hydroxide and methoxide, tetrapentylammonium hydroxide and methoxide, tetrahexylammonium hydroxide and methoxide, and benzylhexadecyldimethyl ammonium hydroxide and methoxide.

20. The method of claim 18 wherein the quaternary base is selected from the group consisting of tetramethylammonium hydroxide and methoxide, tetraethylammonium hydroxide and methoxide, tetrapropylammonium hydroxide and methoxide, tetrabutylammonium hydroxide and methoxide, tetrapentylammonium hydroxide and methoxide, tetrahexylammonium hydroxide and methoxide, and benzylhexadecyldimethyl ammonium hydroxide and methoxide.

* * * * *